US008020696B2

(12) United States Patent
Kim

(10) Patent No.: US 8,020,696 B2
(45) Date of Patent: Sep. 20, 2011

(54) DEVICE AND METHOD FOR STORING AND MIXING AT LEAST TWO MATERIALS

(76) Inventor: Ernest J Kim, Garden Grove, CA (US)

( * ) Notice: Subject to any disclaimer, the term of this patent is extended or adjusted under 35 U.S.C. 154(b) by 37 days.

(21) Appl. No.: 12/615,902

(22) Filed: Nov. 10, 2009

(65) Prior Publication Data

US 2010/0163441 A1 Jul. 1, 2010

Related U.S. Application Data

(60) Provisional application No. 61/203,934, filed on Dec. 29, 2008, provisional application No. 61/205,504, filed on Jan. 20, 2009.

(51) Int. Cl.
*B65D 25/08* (2006.01)

(52) U.S. Cl. ..... 206/221

(58) Field of Classification Search ..... 206/219, 206/221, 220; 215/DIG. 8
See application file for complete search history.

(56) References Cited

U.S. PATENT DOCUMENTS

| | | | | |
|---|---|---|---|---|
| 4,858,760 | A | 8/1989 | Di Sturco | |
| 5,246,142 | A | 9/1993 | DiPalma et al. | |
| 5,370,222 | A | 12/1994 | Steigerwald et al. | |
| 5,711,420 | A | 1/1998 | Spring | |
| 5,772,017 | A | 6/1998 | Kang | |
| 6,003,728 | A | 12/1999 | Elliott | |
| 6,022,134 | A * | 2/2000 | Andrews | 366/130 |
| 6,098,795 | A | 8/2000 | Mollstam et al. | |
| 6,105,760 | A | 8/2000 | Mollstam et al. | |
| 6,148,996 | A | 11/2000 | Morini | |
| 6,209,718 | B1 | 4/2001 | Mollstam et al. | |
| 6,474,861 | B1 | 11/2002 | De Laforcade | |
| 6,543,645 | B2 * | 4/2003 | Lacout | 222/129 |
| 6,644,471 | B1 | 11/2003 | Anderson | |
| 6,769,539 | B2 | 8/2004 | Stern et al. | |
| 6,786,330 | B2 | 9/2004 | Mollstam et al. | |
| 7,055,684 | B2 | 6/2006 | Anderson | |
| 7,279,187 | B2 | 10/2007 | Daniels et al. | |
| 7,308,915 | B2 | 12/2007 | Johns et al. | |
| 2005/0279653 | A1 * | 12/2005 | Williams-Lucas et al. | 206/219 |
| 2006/0185990 | A1 * | 8/2006 | Rybar et al. | 206/219 |
| 2008/0116086 | A1 * | 5/2008 | Hung | 206/222 |

OTHER PUBLICATIONS

U.S. Appl. No. 09/775,486, filed Jun. 21, 2001, Bo Mollstam; Ivan A. Casas.
U.S. Appl. No. 10/995,700, filed Jun. 2, 2005, Young Kook Cho.
U.S. Appl. No. 09/592,217, filed Jun. 12, 2000, Bo Mollstam.
U.S. Appl. No. 08/949,465, filed Aug. 22, 2000, Bo Mollstam.

* cited by examiner

*Primary Examiner* — Jacob K Ackun, Jr.
(74) *Attorney, Agent, or Firm* — Haynes and Boone, LLP

(57) ABSTRACT

In one embodiment, a storing and mixing apparatus is provided and includes a container having a reservoir, a neck, and a seal protrusion extending toward the longitudinal center of the container. The apparatus further includes a cap having a compartment with an off-center funnel part that extends toward an inner surface of the neck and ends in a dispenser opening that engages or disengages with the seal protrusion upon actuation of the cap between a first position and a second position of the dispenser opening relative to the seal protrusion. A method of using such an apparatus is also disclosed.

15 Claims, 3 Drawing Sheets

DEVICE AND METHOD FOR STORING AND MIXING AT LEAST TWO MATERIALS

CROSS-REFERENCE TO RELATED APPLICATIONS

This application claims the benefit of U.S. Provisional Application No. 61/203,934 filed Dec. 29, 2008, and U.S. Provisional Application No. 61/205,504 filed Jan. 20, 2009, the full disclosures of which are incorporated by reference herein for all purposes.

BACKGROUND

1. Field of the Invention

The present invention relates, in general, to containers and, more particularly, pertains to containers having separate compartments in which at least two materials may be stored separately and then may be combined when it is desired to mix them.

2. Description of the Related Art

Many drugs, dyes, vitamins, minerals, enzymes, nutrients, herbs, flavorings, and other chemicals are frequently supplied in powder, granule, tablet, or crystal form and do not retain their stability, strength and effectiveness for long after they have been mixed in solution or suspension, a condition frequently necessary for their administration or other use. It is also important that admixtures of various chemicals be done under conditions wherein a measured amount of one chemical be added to a measured amount of the other chemical to insure that proper results are obtained with a minimum of waste.

For example, some vitamins are combined with an effervescent agent and added to liquid immediately prior to use in order to retain the effectiveness of the vitamins. If the vitamins were mixed with liquid and were not consumed within a short period of time, the vitamins would deteriorate and would be less effective after an extended storage period.

There are many other examples of materials or substances which have an extended shelf life when not mixed, but which must be utilized relatively soon after mixture to prevent deterioration. Various cosmetics, medications, hair dyes, pigments, epoxy adhesives, polishes, cleansing solutions and the like have the foregoing characteristics. For example, conventional hair dyes employ a base material with which a pigmented material or solution is mixed for immediate application on the hair. If the pigmented material is mixed with the base and allowed to stand, the mixture may rapidly deteriorate and thus become unusable.

Many products are, by their very nature, required to be used by the consumer shortly after their manufacture as they lose certain desirable characteristics within a short period of time. Yet, the product can be stored for extended periods of time if a reactive compound thereof is maintained separate from the base compound. In such case, the two compounds may be mixed together to form the desired product shortly before use. In marketing such goods, it is desirable that the reactive compound and the base compound be sold as part of the same package. From an aesthetic as well as a handling standpoint, it is desirable that a single package be utilized for maintaining such compounds separately.

For example, in the chemical, cosmetic and pharmaceutical industries it is often necessary to separately store two products which are not to be mixed until just before the resulting mixture is to be used because the properties of that mixture are not acceptable for the application envisaged except at the moment at which the mixture is formed. The stability of the mixture, for example, is a property which may vary in the course of time and may therefore have values which are most efficacious at the time the mixture is formed.

Another important field of use for containers of this type lies in the storage of foodstuffs and particularly beverages. Thus, a new flavoring, nutrient, additive, etc. constituted of dry ingredients, and being in the form of granular material, or a powder may have been developed for carbonated beverages which has significant potential consumer appeal in comparison with existing products, with the beverage, however, having a limited shelf life after the flavoring is mixed with the liquid or carbonated water present in the container. The flavoring has a lengthier shelf life when maintained in a dry condition and separate from the water or liquid, and with the product being more flavorful, nutrient, additive, etc. and marketable when stored in a container which maintains the flavoring and carbonated water in separate compartments and inaccessible to each other until opening of the container for the purpose of dispensing the beverage.

Many different types of packages have been designed having two compartments to enable product components to be kept separate until use. For example, see U.S. application Ser. No. 09/775,486, filed Feb. 1, 2001, which is a divisional application of U.S. application Ser. No. 09/598,792, filed Jun. 21, 2000, issued as U.S. Pat. No. 6,209,718 20 on Apr. 3, 2001, which is a divisional application of U.S. application Ser. No. 08/949,465, filed Oct. 14, 1997, issued as U.S. Pat. No. 6,105,760 on Aug. 22, 2000; U.S. application Ser. No. 09/592,217, which is a divisional application of U.S. application Ser. No. 09/265,453, filed Mar. 10, 1999, issued as U.S. Pat. No. 6,098,795 on Aug. 8, 2000, which is also a continuation-in-part application of U.S. application Ser. No. 08/949,465, filed Oct. 14, 1997; and U.S. application Ser. No. 10/995,700, filed Nov. 23, 2004, the disclosures of which are incorporated by reference herein for all purposes.

For example, U.S. Pat. No. 6,098,795 discloses a device that may be used for adding a selected first component to a second component that is in a main package, which device keeps the first component from the second component until a selected time before use. The device includes a delivery package which is mountable on the outside surface of the main package, and has a delivery opening, a control opening, and a cavity extending between the delivery opening and the control opening. When there is a first component, a compartment that contains this component is mounted inside the cavity so that it seals the delivery opening with a puncturable seal. A puncturer controllable by a user through the control opening is used for cutting through the compartment, including the puncturable seal, and the package to which the delivery package is mounted to release the first component into the main package at the selected time. This invention requires several moving parts that must be connected together and requires the user to take several actions to combine the ingredients. Also, the puncturable seal, if not fully punctured, may not fully deliver the first component as it may get stuck to the edges of the seal. Finally, any part of the punctured seal may become detached and constitute a hindrance to the good flow of products or of the mixture either as regards the communication between the two containers, or as regards the orifice allowing the mixture to be dispensed to the exterior.

In another reference, U.S. Pat. No. 6,474,861, which is incorporated by reference herein, discloses a device for mixing at least two products. The invention includes a first container containing a first product, and a second container containing a second product, the first and second containers being separated in sealed fashion by a removable stopper, the mixing device further comprising a flexible finger coupled to an operating member and capable, in response to actuation of the operating member, of engaging the stopper and flexing elastically into a position of abutment against a stop borne by the stopper, the flexible finger in this abutment position forming a buttress-like prop capable of moving the stopper so as to allow the first and second products to be mixed. This invention also requires several moving parts that must be connected together and requires the user to take several actions to combine the ingredients. Also, the stopper once detached still constitutes a hindrance to the good flow of products or of the mixture either as regards the communication between the two containers, or as regards the orifice allowing the mixture to be dispensed to the exterior.

Furthermore, the types of structures used for many prior two-compartment containers are complicated and often subject to higher manufacture costs and additional assembly time. Many prior art containers also require the user to execute additional actions, such as pushing down on a push-button, in order to initiate the mixing of the ingredients. Many prior art containers also require a high degree of manufacturing accuracy in order to work as intended. For example, in series production of plastic objects at industrial levels, it can be difficult to obtain consistently accurate results which would guarantee a constantly correct and desired connection between elements requiring a high degree of manufacturing accuracy, such as for a cutting element and a frangible seal.

Further, some prior art packages provide that the compartment stays in the mouth of the container even after a closure device or cap has been extracted and the separately stored materials have been mixed, which represents an obstacle which can interfere with the pouring-out or use of the mixture.

Further, some prior art packages would not work well if it is important that the contents of the container are kept dry. One prior art package describes a plug that would fit into a dispenser opening and prevent the dry contents of the compartment from mixing with the liquid contents of the container. However, the plug is located in the center of the bottle neck, and during the bottling process when liquid is poured into the container, the plug itself would get wet and would then contaminate the contents of the compartment.

Further, some prior art packages require too many additional parts which must be manufactured and assembled together which increases costs and time to manufacture.

Further, some prior art packages require a structure that requires very sturdy parts which may not be strong enough to keep the contents of the compartment dry. One prior art package describes a plug that would fit into a dispenser opening and prevent the contents of the compartment from mixing. The plug itself is supported by supporting attachments which extend radially from the sealing device to the interior wall of the container, which must hold the sealing device tightly in place. Unless the supporting attachments are very rigid, it will not be strong enough to hold the sealing device tightly in place to create a liquid impermeable seal.

Thus, there remains a need to have two-compartment packages which keep the components separate until just before use, which allow the two components to be easily mixed together, and which are simple to manufacture and assemble.

SUMMARY

The present disclosure provides an advantageous package in which two or more separate components may be contained in a separated condition until just before use but which allow the separate components to be easily and efficiently mixed together.

In accordance with one embodiment, a storing and mixing apparatus is provided and includes a container having a reservoir, a neck, and a seal protrusion extending toward the longitudinal center axis of the container. The apparatus further includes a cap having a compartment with an off-center funnel part that extends toward an inner surface of the neck and ends in a dispenser opening that engages or disengages with the seal protrusion upon actuation of the cap between a first position and a second position of the dispenser opening relative to the seal protrusion.

In accordance with another embodiment, a method of storing and mixing is provided, the method including providing an apparatus similar to that described above. The apparatus includes a container having a reservoir, a neck, and a seal protrusion extending toward the longitudinal center axis of the container, the reservoir including a first material; and a cap having a compartment with an off-center funnel part that extends toward an inner surface of the neck and ends in a dispenser opening that is engaged with the seal protrusion, the compartment including a second material different from the first material. The method further includes actuating the cap to disengage the dispenser opening from the seal protrusion; dispensing the second material out of the compartment; and mixing the second material from the compartment with the first material in the reservoir.

Other objects and advantages will be more fully apparent from the following disclosure and appended claims.

BRIEF DESCRIPTION OF THE DRAWINGS

The foregoing and other objects and advantages of the inventive container constructed pursuant to the teachings of the present disclosure may be more readily understood by one skilled in the art, having reference to the following detailed description of preferred embodiments thereof, taken in conjunction with the accompanying drawings, in which.

DETAILED DESCRIPTION

The present disclosure provides a storage and mixing apparatus allowing for the separate storage of at least two materials and the admixing of the materials upon "opening" of the apparatus. For ease of description, the dispensing structure of this invention is described in the normal (upright) operating position, and terms such as upper, lower, horizontal, etc., are used with reference to this position. It will be understood, however, that the dispensing structure of this invention may be manufactured, stored, transported, used, and/or sold in an orientation other than the position described.

Further, this description's terminology is not intended to limit the invention. For example, spatially relative terms, such as "beneath", "below", "lower", "above", "upper" "proximal", "distal", and the like, may be used to describe one element's or feature's relationship to another element or feature as illustrated in the figures. These spatially relative terms are intended to encompass different positions and orientations of the device in use or operation in addition to the position and orientation shown in the figures. For example, if the device in the figures is turned over, elements described as "below" or "beneath" other elements or features would then be "above" or "over" the other elements or features. Thus, the exemplary term "below" can encompass both positions and orientations of above and below. The device may be otherwise oriented (rotated 90 degrees or at other orientations), and the spatially relative descriptors used herein interpreted accordingly. In addition, the singular forms "a", "an", and "the" are intended to include the plural forms as well, unless the context indicates otherwise. And, the terms "comprises", "comprising", "includes", and the like specify the presence of stated features, steps, operations, elements, and/or components but do not preclude the presence or addition of one or more other features, steps, operations, elements, components, and/or groups. Components described as coupled may be electrically or mechanically, directly coupled, or they may be indirectly coupled via one or more intermediate components.

Figure 1:
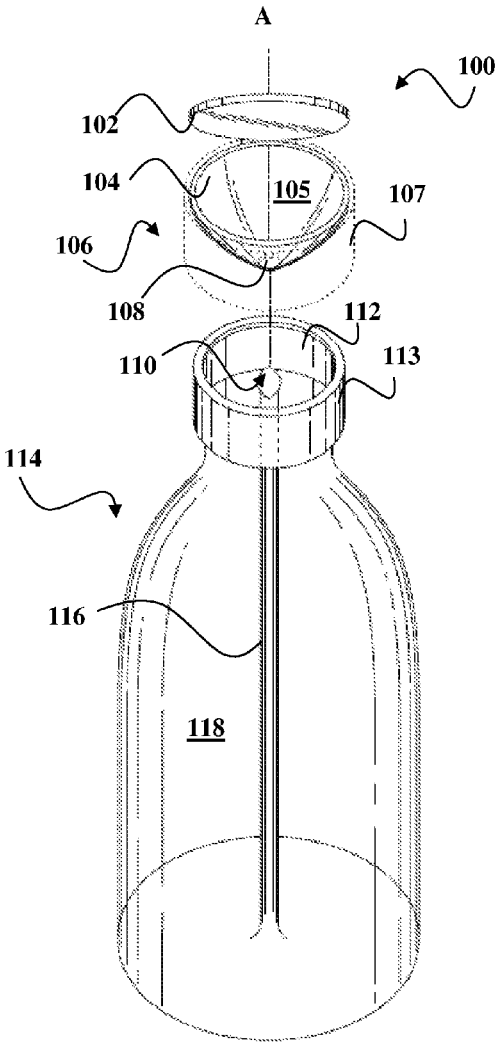
FIG. 1 illustrates a perspective view of a container in accordance with an embodiment of the present disclosure.

Referring now to FIG. 1, a storage and mixing apparatus 100 includes a container 114 and a mixing cap 106 in accordance with an embodiment of the present disclosure. Container 114 is adapted to hold a quantity of a first material, such as a liquid (not shown) or other solvent, in an interior reservoir 118, and includes an opening 112 via a neck 113, which allows access to the interior reservoir 118 of the container 114 and which further allows the first material (e.g., a liquid) to be supplied to or withdrawn from container 114. Container 114 may be made of various materials, and in one example may be comprised of a plastic, a metal, or various chemically-inert materials. Container 114 may have a single reservoir 118 or alternatively may include a plurality of reservoirs to hold different materials or different amounts of the same material. In this embodiment, container 114 is in the shape of a bottle having a single reservoir and neck 113 which leads to opening 112. In this embodiment, neck 113 is cylindrical with vertical sidewalls but may have differently configured walls in other embodiments, as noted below with respect to FIGS. 4-8.

Mixing cap 106 is adapted to move between a first position over opening 112 (e.g., a "closed" position to close a dispenser opening of the cap) and a second position over opening 112 (e.g., an "opened" position to open a dispenser opening of the cap) while also being adapted to store a second material in the first position and to provide for mixing of the second material with the first material in the second position, or vice versa. In one embodiment, mixing cap 106 incorporates a compartment 104 for storing the second material (not shown), such as liquid-soluble flavorings, vitamins, minerals, enzymes, nutrients, herbs, microbial cultures, coloring agents, chemicals, etc., which is segregated from the first material prior to use. In one example, compartment 104 is conical in shape and is located in an interior underside of the mixing cap 106. An outer shell 107 of the mixing cap 106 is outlined by dotted lines to show the interior compartment 104. Outer shell 107 couples mixing cap 106 to the neck of container 114 by one of various means and techniques, such as by screw threads (e.g., mating screw threads on an interior surface of the outer shell 107 with an exterior surface of container 114 adjacent opening 112), a slidable joint, glue, induction melting, ultrasonic melting, or the like. Compartment 104 may be manufactured as a unitary member of the mixing cap 106 in one embodiment, or alternatively may be manufactured as a separate member that is operably couplable to the outer shell of mixing cap 106. In this embodiment, cap 106 includes a single compartment 104, but in other embodiments, cap 106 may include multiple compartments to hold different second materials or different amounts of the same second material. A lid 102 is operably coupled to compartment 104, in one example, to access an interior 105 of the compartment 104 for provision of the second material. Lid 102 may be coupled to compartment 104 in various ways, such as by a movable joint (e.g., a hinge joint), screw threads, tabs, friction fit, and so on.

Compartment 104 further includes a dispenser opening 108 at the tapered end of the conically-shaped compartment 104, which opens to the interior reservoir 118 of container 114. In one example, dispenser opening 108 is a small aperture approximately at a vertex of a downward conically-shaped compartment 104 such that the second material in the compartment 104 is directed downward toward the container 114. The dispenser opening 108 allows the second material to fall from the compartment by gravity or user agitation when the mixing cap 106 is in an opened position over container 114 and to combine with the first material within container 114 when the dispenser opening is unobstructed. During storage, the dispenser opening 108 is obstructed by a seal protrusion to completely block the dispenser opening in order to prevent a leak of the second material and the first and second materials from combining. When detached from the seal, the second material contents of the compartment can drop through the dispenser opening into the interior of the container and mix with the first material. In one example, the seal may include or be comprised of a rigid material or plastic that snap-fits with dispenser opening 108 such that the second material held within the compartment 104 does not dispense (i.e., a liquid-impermeable seal is created). In another example, the seal may be a deformable material that seals the dispenser opening and/or the lip of the dispenser opening can be made of deformable material which may be pressed tightly against the seal in order to create a liquid-impermeable seal. In yet another example, the seal may have a tapered shape with a point that enters compartment 104 through dispenser opening 108 and then seals the opening.

In one embodiment, dispenser opening 108 may be sealed by a seal 110 provided within container 114, and more particularly in one example, within neck 113. FIG. 1 illustrates seal 110 upheld on an elongated shaft 116 along a longitudinal center axis "A" of container 114, with one end of shaft 116 coupled to the center of a base of container 114 and a free end of post 116 coupled to seal 110. Seal 110 is operably couplable to dispenser opening 108 within neck 113, such that when mixing cap 106 is in a closed position, seal 110 seals or blocks dispenser opening 108. Then, in an embodiment where a screw thread is used to secure the mixing cap to the container, when the mixing cap is twisted open to move the mixing cap to an opened position, mixing cap 106, compartment 105, and dispenser opening 108 are moved vertically-upwards away from seal 110. Such vertically-upward movement will cause the dispenser opening 108 to separate from seal 110 which will allow the second material to drop down through dispenser opening 108 and to combine with the first material within container 114. In this embodiment, additive second material may be deposited into the compartment 104 through the open top surface of the mixing cap 106 after the dispenser opening is coupled to the seal.

In another embodiment, a frangible cover (not shown) can be used to cover the dispenser opening, and the seal 110 can have a cutting or piercing device to puncture the frangible cover. In one example, the cover can be composed of a synthetic plastic-coated aluminum foil which can be connected by heat seal. Container 114, neck 113, and/or post 116 may be manufactured to have a height such that the end of seal 110 does not contact or puncture the cover when mixing cap 106 is initially coupled to container 114 during a capping/closure process. The cover will allow the mixing cap to be attached to the container in the normal (upright) position at a manufacturing site, such as a bottling facility, without risk of the contents of the compartment 104 spilling out when the mixing cap is attached to the container during the capping/closure process. Then, during an opening process, mixing cap 106 may be moved vertically downwards toward the cutting or piercing end of seal 110, and the cover over dispenser opening 108 may be punctured when the seal 110 is inserted into the dispenser opening 108. The downward movement of mixing cap 106 (and therefore the downward movement of the cover over dispenser opening 108) may be actuated by the user with the mixing cap coupled to the container 114 by screw threads or a sliding means for example. After the cover is punctured or otherwise opened, the mixing cap 106 is moved upwards away from seal 110, and the second material within compartment 104 is dispensed to be mixed with the first material within container 114.

In another embodiment, the compartment 104 is cylindrically shaped (instead of conically-shaped) and positioned to extend at least partially into the neck 113 in close conformance with the inner diameter thereof and with the dispenser opening 108 being innermostly located in the bottle neck.

In another embodiment, the compartment 104 can be made in different heights to accommodate different volumes of the second material and thereby providing for different mixing ratios in the arrangement. In a preferred embodiment, the compartment shall be adapted to extend into the container opening but need not be so configured.

In another embodiment, the mixing cap can be adapted to hold additive ingredients in a push-pull resealable closure spout. These spouts are generally characterized by having an orificed spout slidably moveable on a cylindrical tube. In this embodiment, the bottom portion of the tube which extends into the container can contain reservoirs or chambers which store an additive ingredient. Linear motion of the spout relative to the tube alternatively causes the plug to seal or unseal the spout orifice. When the orificed spout is pulled upwards, the bottom portion of the orificed spout will expose the reservoirs or chambers, which will release the additive down into the interior bottom of the container.

In another embodiment of the invention, the compartment can contain vertical dividing walls within the compartment 104 which creates a plurality of compartments. Each compartment can contain a different material or different amounts of the same material, with each compartment having access and being connected to a portion of the dispenser opening.

In another embodiment of the invention, the compartment can include colorant which would create visual stimulation to the user when the materials are mixed together. Visual stimulation increases the interest in using and consuming food items. The colorant can be mixed with a clear or neutral beverage for visual entertainment while consuming the beverage.

Figure 2:
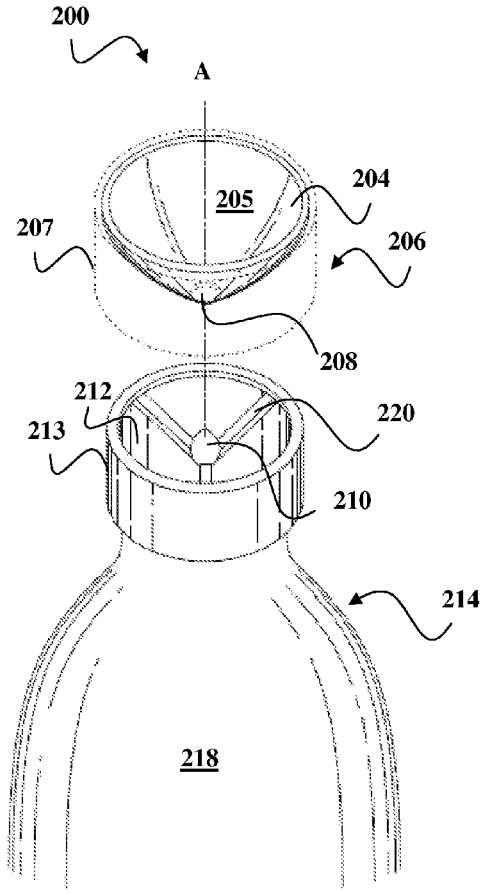
FIG. 2 illustrates a perspective view of a container in accordance with another embodiment of the present disclosure.

Referring now to FIG. 2, a storage and mixing apparatus 200 is illustrated in accordance with an embodiment of the present disclosure. Apparatus 200 includes a container 214 and a mixing cap 206. Container 214 is adapted to hold a quantity of a first material, such as a liquid (not shown), in an interior reservoir 218, and includes an opening 212 via a neck 213, which allows access to the interior reservoir 218 of the container 214 and which further allows the first material (e.g., a liquid) to be supplied to or withdrawn from container 214. Container 214 may be made of various materials, and in one example may be comprised of a plastic, a metal, or various chemically-inert materials. Container 214 may have a single reservoir 218 or alternatively may include a plurality of reservoirs. In this embodiment, container 214 is in the shape of a bottle having neck 213 which leads to opening 212.

Mixing cap 206 is adapted to move between a first position over opening 212 (e.g., a "closed" position to close or block a dispenser opening) and a second position over opening 212 (e.g., an "opened" position to open or unblock the dispenser opening) while also being adapted to store a second material in the first position and to provide for mixing of the second material with the first material in the second position, or vice versa. In one embodiment, mixing cap 206 incorporates a compartment 204 for storing the second material (not shown), such as liquid-soluble flavorings, vitamins, minerals, enzymes, nutrients, herbs, microbial cultures, coloring agents, chemicals, etc., which is segregated from the first material prior to use. In one example, compartment 204 is conical in shape and is located in an interior underside of the mixing cap 206. An outer shell 207 of the mixing cap 206 is outlined by dotted lines to show the interior compartment 204. Outer shell 207 couples mixing cap 206 to container 214 by one of various means and techniques, such as by screw threads (e.g., mating screw threads on an interior surface of the outer shell 207 with an exterior surface of container 214 adjacent opening 212), a slidable joint, glue, induction melting, ultrasonic melting, or the like. Compartment 204 may be manufactured as a unitary member of the mixing cap 206 in one embodiment, or alternatively may be manufactured as a separate member that is operably couplable to the outer shell of mixing cap 206.

A lid is not illustrated but may be operably coupled to compartment 204, in one example, as shown in FIG. 1. In another embodiment, the mixing cap can be formed as a hollow body, with the bottom end consisting of the dispenser opening, and the top end of the mixing cap being open and unsealed. During manufacture, the mixing cap can be attached to the container, and with the seal obstructing the dispenser opening on the bottom end of the compartment, the additive can be deposited into the compartment from the top of the mixing cap. Then, the top end of mixing cap 206 can be sealed, covered, or closed to contain and store the additive in the compartment 204.

Compartment 204 further includes a dispenser opening 208, which opens to the interior reservoir 218 of container 214. In one example, dispenser opening 208 is substantially at a vertex of a downward conically-shaped compartment 204 such that the second material in the compartment 204 is directed downward toward the container 214. The dispenser opening 208 allows the second material to fall from the compartment by gravity when the mixing cap 206 is in an opened position over container 214 and combine with the first material within container 214 when the dispenser opening is unobstructed. During storage, the dispenser opening 208 is obstructed by a seal to completely block the dispenser opening in order to prevent the first and second materials from combining. When detached from the seal, the second material contents of the compartment can drop through the dispenser opening into the interior of the container and mix with the first material.

In one embodiment, dispenser opening 208 may be sealed by a seal 210 provided within container 214 and in one example within neck 213. FIG. 2 illustrates seal 210 not upheld on a post but coupled to neck 213 by ribs 220 extending radially from seal 210 and angled upward toward inner neck walls. In this embodiment, seal 210 is located along the transverse center of container 214 or the longitudinal center axis "A" of container 214. Three ribs 220 are illustrated but other numbers of ribs may uphold seal 210. Ribs 220 are also angled such that mixing cap 206 including conically-shaped compartment 204 may be operably coupled to seal 210 within neck 213. Seal 210 is similar to seal 110 and may include a rigid plastic that snap-fits with dispenser opening 208 such that the second material held within the compartment 204 does not dispense (i.e., creates a liquid-impermeable seal). In another example, the seal may be a deformable material that seals the dispenser opening. In yet another example, the seal may have a tapered shape with a point that enters compartment 204 through dispenser opening 208 and then seals the opening.

In another embodiment, a frangible cover (not shown) can be used to cover the dispenser opening and the seal 210 can have a cutting or piercing device to puncture the frangible cover. In one example, the cover can be composed of a synthetic plastic-coated aluminum foil which can be connected by heat seal. Container 214, neck 213, and/or the radial angle of ribs 220 may be manufactured to provide a height such that the end of seal 210 does not contact or puncture the cover when mixing cap 206 is initially coupled to container 214 during a capping/closure process. The cover will allow the mixing cap to be attached to the container in the normal (upright) position at a manufacturing site, such as a bottling facility, without risk of the contents of the compartment 204 spilling out when the mixing cap is attached to the container during the capping/closure process. Then, during an opening process, mixing cap 206 may be moved vertically downwards toward the cutting or piercing end of seal 210, and the cover over dispenser opening 208 may be punctured when the seal 210 is inserted into the dispenser opening. The downward movement of mixing cap 206 and therefore the cover over dispenser opening 208 may be actuated by the user with the mixing cap coupled to the container 214 by screw threads or a sliding means for example. After the cover is punctured or otherwise opened, the mixing cap 206 is moved upwards away from seal 210, and the second material within compartment 204 is dispensed to be mixed with the first material within container 214.

Seal 210 operates otherwise in a similar fashion as described above with respect to seal 110. Mixing cap 206 and container 214 may also include the features described above with respect to mixing cap 106 and container 114.

Figure 3A:
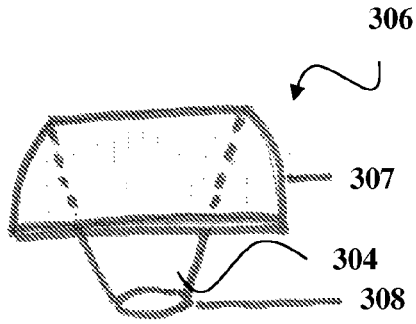
FIG. 3A illustrates a side view of the separate cap of FIG. 3, and FIGS. 3B1-3B2 illustrate a side view and a top view, respectively, of the separate neck of FIG. 3 in accordance with the present disclosure.
Figure 3A:
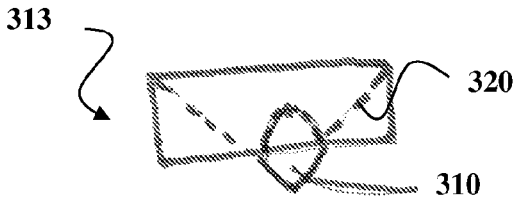
Figure 3A:
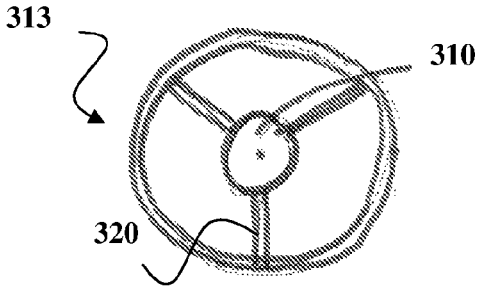
Figure 3:
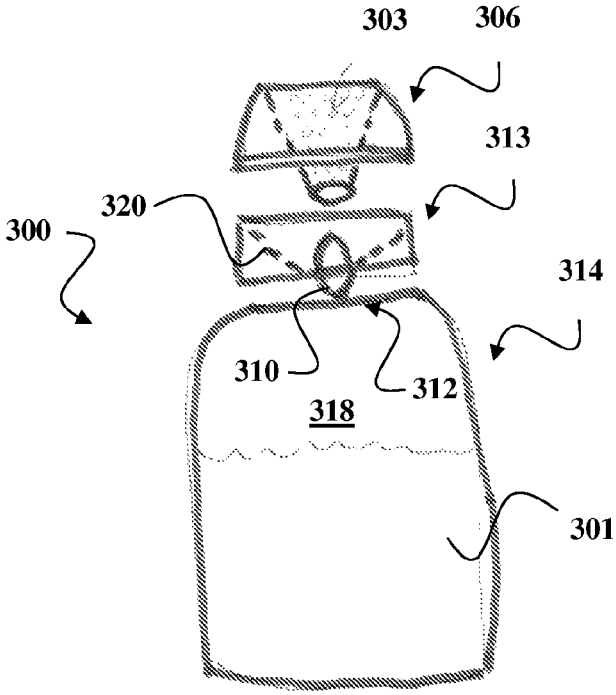
FIG. 3 illustrates a side view of a container including a modular cap and a modular neck in accordance with another embodiment of the present disclosure.
Figure 4:
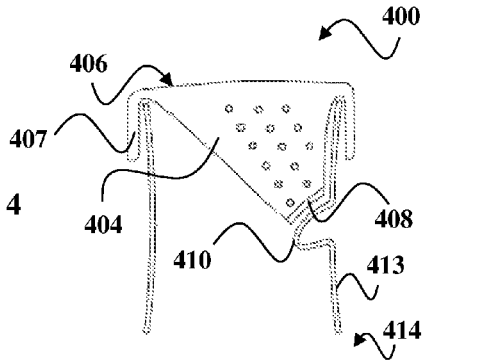
FIGS. 4-8 illustrate side sectional views of containers in accordance with different embodiments of the present disclosure.

Referring now to FIG. 3, an exploded side view of a storage and mixing apparatus 300 is illustrated in accordance with another embodiment of the present disclosure. In this embodiment, apparatus 300 includes a container 314, a separate neck 313 that couples to container 314, and a separate cap 306 that couples to neck portion 313. FIG. 3A illustrates a side view of the separate cap 306, and FIGS. 3B1-3B2 illustrate a side view and a top view, respectively, of the separate neck 313 in accordance with the present disclosure.

Container 314 is adapted to hold a quantity of a first material 301, such as a liquid, in an interior reservoir 318, and includes an opening 312 which allows access to the interior reservoir 318 of the container 314 and which further allows the first material to be supplied to or withdrawn from container 314.

Cap 306 is adapted to move between a first position over container opening 312 (e.g., a "closed" position to close or block a dispenser opening) and a second position over opening 312 (e.g., an "opened" position to open or unblock the dispenser opening) while also being adapted to store a second material 303 in the first position and to provide for mixing of the second material with the first material in the second position, or vice versa. In one embodiment, cap 306 incorporates a compartment 304 for storing the second material 303, such as liquid-soluble flavorings, vitamins, minerals, enzymes, nutrients, herbs, microbial cultures, coloring agents, chemicals, etc., which is segregated from the first material prior to use. In one example, compartment 304 is conical in shape and is located in an interior underside of the cap 306. An outer shell 307 of the cap 306 couples the cap 306 to neck 313 by one of various means and techniques, such as by screw threads (e.g., mating screw threads on an interior surface of the outer shell 307 with an exterior surface of neck 313), a slidable joint, glue, induction melting, ultrasonic melting, or the like. Compartment 304 may be manufactured as a unitary member of the mixing cap 306 in one embodiment, or alternatively may be manufactured as a separate member that is operably couplable to the outer shell of mixing cap 306.

A lid is not illustrated but may be operably coupled to compartment 304, in one example, as shown in FIG. 1. In another embodiment, the cap can be formed as a hollow body, with the bottom end consisting of the dispenser opening, and the top end of the mixing cap being open and unsealed. During manufacture, the cap can be attached to the neck 313, and with the seal obstructing the dispenser opening on the bottom end of the compartment, the additive can be deposited into the compartment from the top of the cap. Then, the top end of cap 306 can be sealed, covered, or closed to contain and store the additive in the compartment 304.

Compartment 304 further includes a dispenser opening 308, which opens to the interior reservoir 318 of container 314 when cap 306 and neck 313 are coupled to container 314. In one example, dispenser opening 308 is substantially at a vertex of a downward conically-shaped compartment 304 such that the second material in the compartment 304 is directed downward toward the container 314. The dispenser opening 308 allows the second material to fall from the compartment by gravity when the cap 306 is in an opened position over container 314 and combined with the first material within container 314 when the dispenser opening is unobstructed. During storage, the dispenser opening 308 is obstructed by seal 310 to completely block the dispenser opening in order to prevent the first and second materials from combining. When detached from the seal, the second material contents of the compartment can drop through the dispenser opening into the interior of the container and mix with the first material.

Neck portion 313 includes a seal 310 upheld by ribs 320 extending radially from seal 310 and angled upward toward a circular inner wall of the neck portion 313. In this embodiment, seal 310 is positioned along the transverse center of neck portion 313 or the longitudinal center axis of the container assembly (e.g., axis "A" of FIG. 2). Three ribs 320 are illustrated but other numbers of ribs may uphold seal 310. Ribs 320 are also angled such that cap 306 including conically-shaped compartment 304 may be operably coupled to seal 310 within neck portion 313. Seal 310 is similar to seal 110 and may include a rigid plastic that snap-fits with dispenser opening 308 such that the second material held within the compartment 304 does not dispense (i.e., creates a liquid-impermeable seal). In another example, the seal may be a deformable material that seals the dispenser opening. In yet another example, the seal may have a tapered shape with a point that enters compartment 304 through dispenser opening 308 and then seals the opening.

In another embodiment, a frangible cover (not shown) can be used to cover the dispenser opening and the seal 310 can have a cutting or piercing device to puncture the frangible cover. In one example, the cover can be composed of a synthetic plastic-coated aluminum foil which can be connected by heat seal. The cover will allow the mixing cap to be attached to the container in the normal (upright) position at a manufacturing site, such as a bottling facility, without risk of the contents of the compartment 304 spilling out when the mixing cap is attached to the container during the capping/closure process. Then, during an opening process, cap 306 may be moved vertically downwards toward the cutting or piercing end of seal 310, and the cover over dispenser opening 308 may be punctured when the seal 310 is inserted into the dispenser opening. The downward movement of mixing cap 306 and therefore the cover over dispenser opening 308 may be actuated by the user with the mixing cap coupled to the container 314 by screw threads or a sliding means for example. After the cover is punctured or otherwise opened, the cap 306 is moved upwards away from seal 310, and the second material within compartment 304 is dispensed to be mixed with the first material within container 214.

Seal 310 operates otherwise in a similar fashion as described above with respect to seal 110. Cap 306 and container 314 may also include the features described above with respect to mixing cap 106 and container 114.

Referring now to FIGS. 4-8, side sectional views of storage and mixing apparatus 400, 500, 600, 700, and 800 are respectively illustrated in accordance with different embodiments of the present disclosure.

Apparatus 400 includes a mixing cap 406 that includes a compartment 404, an outer shell 407, and a dispenser opening 408. The mixing cap is operably coupled to a container 414 that includes a reservoir (not shown but can be similar to reservoirs 118 and 218 of FIGS. 1 and 2), a neck 413, and a seal protrusion 410 which extends inwardly toward the longitudinal center axis of the cap 406 (as shown by line "A" in FIGS. 1 and 2) in one example. Compartment 404 includes a funnel-shaped part ending with dispenser opening 408 and extending downward and off-center (from a longitudinal axis of the container 414) toward an inner wall of the neck 413. The cap 406 and dispenser opening 408 are illustrated as engaged with seal protrusion 410 in a first position so as to close, block, or seal the dispenser opening 408 such that a material within compartment 404 does not leak through the dispenser opening. When the cap 406 is actuated by the user into a second position, for example by twisting the cap or translating the cap in a vertically upward or downward direction, dispenser opening 408 is opened, unblocked, or disengaged and moves from seal protrusion 410 in a transverse or vertical direction such that dispenser opening 408 opens to the interior of the container 414. Dispenser opening 408 is directed sideways towards the interior wall of the container when the cap 406 is fitted onto the container.

When the user removes the cap 406 from the container 414, the compartment 404 of cap 406 is removed with the cap. If the cap couples to the container by a screw-type mechanism, twisting open the cap will move the dispenser opening sideways and upwards, in one example, thereby detaching the dispenser opening 408 from the seal protrusion 410. When detached from the seal protrusion, the contents of the cap compartment can drop through the dispenser opening into the interior of the container and mix with the first material.

Figure 8:
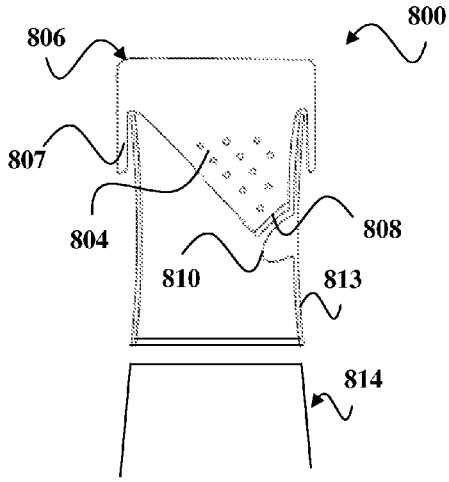

In this embodiment, seal protrusion 410 is formed from a wall of neck 413 which extends into the interior space within the neck. In another embodiment, as illustrated in FIG. 8, an apparatus 800 includes a mixing cap 806 that includes a compartment 804, an outer shell 807, and a dispenser opening 808. Mixing cap 806 is operably coupled to a neck 813 and a seal protrusion 810. Seal protrusion 810 is attached to the interior wall of neck 813 and will protrude inwardly from the inner wall of the neck toward a longitudinal axis of the container (e.g., longitudinal axis "A" illustrated in FIGS. 1 and 2). In both embodiments, the seal protrusion 810 may extend from the interior wall slightly and may be angled downward so when the dispenser opening detaches from the seal protrusion, the second material held within the compartment of the cap will fall freely from the compartment toward the first material held within the container.

Advantageously, the dispenser opening is off-center (i.e., the funnel part of compartment 404 ending with dispenser opening 408 is directed downward and sideways off-center from a longitudinal center axis of the cap or container, which is illustrated as line "A" in FIGS. 1 and 2) and so when the dispenser opening is rotated when the user twists the cap to open or close the container, centrifugal force will help discharge and dislodge the contents of the cap compartment into the container.

Another advantage is that the dispenser opening is rotated into a connected position with the seal protrusion when the cap is attached to the container. By the rotation action, any liquid that is left on the surface of the seal protrusion from the bottling process will be wiped away by the lip of the dispenser opening before the seal protrusion is positioned to obstruct the dispenser opening.

Yet another advantage is that in one embodiment, the seal protrusion is integrally molded into the bottle as an indentation in the bottle structure and so the seal protrusion will stay firm and unyielding even if the dispenser opening is pressing down on the seal protrusion with a large force.

Figure 5:
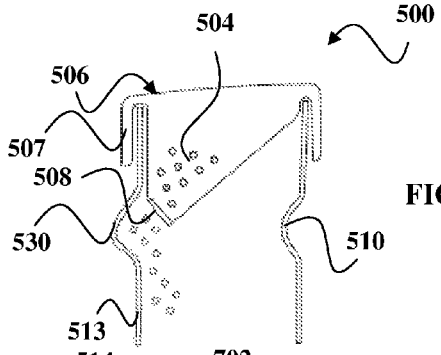

Referring now to FIG. 5, an apparatus 500 is illustrated, including a mixing cap 506 that includes a compartment 504, an outer shell 507, and a dispenser opening 508 at an end of a funnel part of compartment 504 directed downwards and sideways, or in other words off-center from a longitudinal center axis of the cap 506 or container 514 (as illustrated by line "A" in FIGS. 1 and 2). Cap 506 is operably coupled to a container 514 via neck 513 that includes an inwardly extending seal protrusion 510 and an outwardly extending protrusion 530. In one embodiment, outwardly extending protrusion 530 is opposite seal protrusion 510 and extends in a parallel direction as seal protrusion 510. Advantageously, in this embodiment, when the dispenser opening 508 is disengaged from the seal protrusion 510 (by rotation in one example), dispenser opening 508 may be positioned adjacent protrusion 530 so that the material in compartment 504 of cap 506 can be freely dispensed downwardly into container 514 via the space created within neck 513 by outwardly extending protrusion 530.

Figure 6:
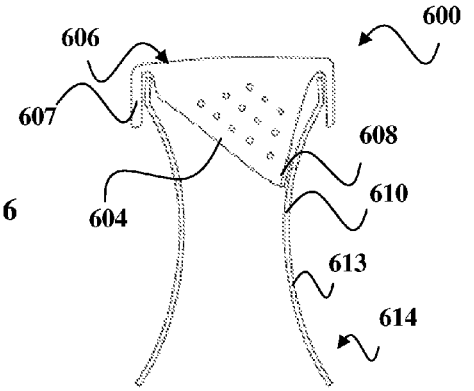

Referring now to FIG. 6, an apparatus 600 is illustrated, including a mixing cap 606 that includes a compartment 604, an outer shell 607, and a dispenser opening 608 at an end of a funnel part of compartment 604 directed downwards and sideways, or in other words off-center from a longitudinal center axis of the cap 606 or container 614 (as illustrated by line "A" in FIGS. 1 and 2). Cap 606 is operably coupled to a container 614 that includes a neck 613 and a seal protrusion 610. In this embodiment, the seal protrusion 610 is part of the container neck 613, which can be in the form of an hourglass shape having neck walls that taper toward a central channel, and the dispenser opening 608 can be attached near the central channel area of the hourglass-shaped neck. When the cap 606 is opened, in one embodiment, the dispenser opening can be lifted vertically to a section of the hourglass-shaped neck that is wider, thereby unobstructing the dispenser opening and allowing for the material within compartment 604 to be dispensed. In another embodiment, neck 613 may be hourglass-shaped only along one direction and uniformly wider along a second direction, such that dispenser opening 608 may be disengaged from the seal protrusion 610 of neck 613 by rotating the cap and therefore rotating the dispenser opening 608 into an open space to dispense material from the cap compartment.

Figure 7:
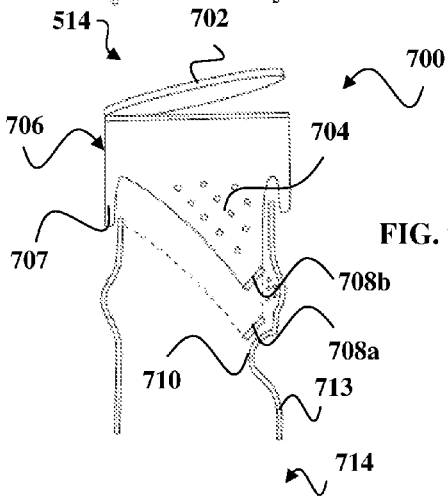

Referring now to FIG. 7, an apparatus 700 is illustrated, including a mixing cap 706 that includes a compartment 704, an outer shell 707, and a dispenser opening 708 operably coupled to a container 714 that includes a neck 713 and a seal protrusion 710. FIG. 7 illustrates vertical movement of cap 706 to vertically translate dispenser opening 708 from a first position 708*a* to a second position 708*b* in order to disengage the dispenser opening from seal protrusion 710, thereby allowing for the release of material within compartment 704. A lid 702 is operably coupled to a top opening of compartment 704.

In the embodiments described above with respect to FIGS. 4-8, similar elements may have common structures and/or functionality as those described above with respect to FIGS. 1 and 2. For example, caps 406-806 may be operably coupled to necks 413-813, respectively, by the outer shell coupling to the neck of the container by one of various means and techniques, such as by screw threads (e.g., mating screw threads on an interior surface of the outer shell with an exterior surface of the neck), a slidable joint, glue, induction melting, ultrasonic melting, or the like. Also, compartments may be manufactured as a unitary member of the mixing caps in one embodiment, or alternatively may be manufactured as a separate member that is operably couplable to the outer shell of a mixing cap. Furthermore, caps and containers may include a single compartment and reservoir, respectively, or caps and containers may include multiple compartments and reservoirs. In addition, the seal protrusions may include a rigid plastic end that snap-fits with a dispenser opening to create a liquid-impermeable seal, or the seal protrusion/dispenser opening lip may include a deformable material that seals the interface between the seal protrusion and the dispenser opening. In yet another example, the seal protrusion may have a tapered shape with a point that enters the compartment through the dispenser opening and then seals the opening. A cover, as described above, may also be placed over the dispenser opening.

In yet another embodiment, the cap and neck portions illustrated in FIGS. 4-7 may be separately manufactured from a remainder of a container or from a receiving neck and container assembly, as illustrated in FIG. 8. For example, cap 406 and neck 413, cap 506 and neck 513, cap 606 and neck 613, and cap 706 and neck 713 may be manufactured as separate assemblies from a container portion (the container portion may include a reservoir and a receiving neck portion). The distal end of the neck of the cap and neck assembly may then be coupled to a proximal end of the container or the receiving neck and container assembly. The cap and neck assembly may be coupled to the container or the receiving neck portion of the neck and container assembly by mating screw threads, glue, or other attachment means and techniques that allow for a sufficient seal to prevent liquid from leaking from the coupled assemblies.

Advantageously, the present disclosure provides a package in which two or more separate products may be contained in a separated condition. Means are also provided for separately storing at least two materials or ingredients of a product within a container prior to opening of the container and which, upon opening of the container closure, provides for the automatic admixing of the separately stored materials. The present disclosure further provides for longer storage times of materials which would degrade if mixed together by providing for separate storage compartments for each such material. In such case, the two compounds may be mixed together to form the desired product shortly before use in order to preserve efficacy. The present disclosure may also obviate the need to refrigerate ingredients to preserve efficacy. The present disclosure further permits a reactive compound and a base compound to be sold as part of the same package. From an aesthetic as well as a handling standpoint, it is desirable that a single package be utilized for separately maintaining such compounds. The present disclosure further permits combining of the ingredients by a simple single motion of opening the closure device. The present disclosure further provides a means for maintaining properly proportioned amounts of the ingredients in one container, so that the user may easily and quickly mix proper amounts in an accurate and uniform manner, and very quickly and economically within a prepackaged container. The present disclosure further provides a novel attachment for a container closure device with a dispensing opening which has a bottom end opening suitable for use as a compartment or reservoir for the storage of a material or chemical. The present disclosure further provides a container which may be easily manufactured or fabricated from readily available materials and which is relatively inexpensive and relatively fool-proof in use. The present disclosure further provides an improved device permitting the user to conveniently combine two or more ingredients without the necessity of contacting the ingredients used and without the risk of spillage. The present disclosure further provides a package for storing and mixing a plurality of ingredients with a minimum of time and effort. The present disclosure further provides a novel package for storing, mixing and then dispensing ingredients with little or no danger of contamination. The present disclosure further provides for the conservation of resources and decreases manufacturing time and costs with the use of less materials. The present disclosure also provides a sealing device that is solidly supported in a position to prevent any mixture between the separated ingredients until intended. The present disclosure further provides for centrifugal force in assisting in the emptying and discharging of the contents of the compartment when mixing the separated ingredients. The present disclosure further provides a method for proportioning ingredients for the purpose of accurate and expeditious mixing immediately prior to use. The present disclosure further provides for the release of pressure which may result from the combining of the ingredients because the single action of removing the closure which causes the combining of the ingredients will also cause air to enter the container. The present disclosure further provides a container which is simple to construct, easy to operate both as to filling with the separated ingredients and as to discharge of the mixed product, and which embodies certain safety features which protect against accidental, premature mixing of the separated ingredients, and against accidental discharge of the mixed product. The present disclosure further keeps the sealing device from getting wet during the bottling process when liquid is poured into the container. Because the closure device is rotated into position over the sealing device, the lip of the dispenser opening will be able to wipe away stray liquid on the surface of the sealing device before the sealing device is engaged onto the dispenser opening.

Finally, in one embodiment, the present disclosure provides a container which is adapted to separately store at least two materials, including a structure for separating the constituents by a liquid-impermeable barrier; and which will allow for utilization of a standard size beverage can or bottle; which will require little or no modification of a standard container whereby any increase in container cost is minimal; will pour easily when opened; will not contain loose debris from the barrier after opening; and will be compatible with standard carbonated beverage filling and sealing equipment, with the possible exception that special provisions may be required to fill the powder into its compartment in the closure.

Although several embodiments of the invention have been described herein in detail, the teachings of the present invention will suggest many other embodiments to those skilled in the art. For instance, although only two separately stored ingredients for a product are shown and described in the disclosed embodiments, it should be apparent to one skilled in the art that embodiments fall within the scope of the invention wherein three or more materials may be separately stored and automatically admixed upon or preceding opening of the container. For example, the cap compartments and/or the container reservoirs may be sectioned to include space for separately storing more than one material in each cap compartment and/or container reservoir. Furthermore, although several types of convenience openers for the containers have been illustrated, other types of openers may be used in other embodiments or modifications of the invention. While this invention is susceptible of embodiment in many different forms, this specification and the accompanying drawings disclose only some specific forms as examples of the invention. The invention is not intended to be limited to the embodiments so described, however. It should also be understood that numerous modifications and variations are possible in accordance with the principles of the present invention. Accordingly, the scope of the invention is defined only by the following claims.

What is claimed is:

1. A storing and mixing apparatus, comprising:

a container including a reservoir, a neck, and a seal protrusion extending toward the longitudinal center axis of the container; and a cap including a compartment with an off-center funnel part that extends toward an inner surface of the neck and ends in a dispenser opening that engages or disengages with the seal protrusion upon actuation of the cap between a first position and a second position of the dispenser opening relative to the seal protrusion.

2. The apparatus of claim 1, wherein the seal protrusion is formed by a neck wall.

3. The apparatus of claim 1, wherein the seal protrusion is attached to the inner surface of the neck.

4. The apparatus of claim 1, wherein the neck includes an outwardly protruding neck wall opposite to the seal protrusion.

5. The apparatus of claim 1, wherein the neck includes an outwardly protruding neck wall above the seal protrusion.

6. The apparatus of claim 1, wherein the neck includes an outwardly protruding neck wall extending in a parallel direction as the seal protrusion.

7. The apparatus of claim 1, wherein the neck includes an hour glass shape with neck walls that inwardly taper toward a central channel, the seal protrusion being formed by an inner surface of a neck wall adjacent the central channel.

8. The apparatus of claim 1, wherein the cap is movably coupled with the neck.

9. The apparatus of claim 1, wherein the cap is movably coupled with the neck through screw-type engagement.

10. The apparatus of claim 1, wherein the dispenser opening is rotatable about a longitudinal axis of the container.

11. The apparatus of claim 1, wherein the dispenser opening is transversely movable relative to the seal protrusion.

12. The apparatus of claim 1, wherein the dispenser opening is vertically movable relative to the seal protrusion.

13. The apparatus of claim 1, wherein the cap further includes a movable lid that provides access to the compartment of the cap.

14. The apparatus of claim 1, wherein the container is formed of a metal and the cap is formed of a plastic.

15. The apparatus of claim 1, wherein the reservoir of the container stores a first material and the compartment of the cap stores a second material different from the first material.

* * * * *